US009803329B1

(12) United States Patent
El-Sheikhy et al.

(10) Patent No.: US 9,803,329 B1
(45) Date of Patent: Oct. 31, 2017

(54) EXPANSIVE SOIL RESISTANT FOUNDATION SYSTEM

(71) Applicant: KING SAUD UNIVERSITY, Riyadh (SA)

(72) Inventors: Refat Ahmed Ibrahim El-Sheikhy, Riyadh (SA); Mosleh Ali Al-Shamrani, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 15/178,476

(22) Filed: Jun. 9, 2016

(51) Int. Cl.
*E02D 19/00* (2006.01)
*E02D 27/32* (2006.01)
*E02D 31/02* (2006.01)

(52) U.S. Cl.
CPC ..... *E02D 27/32* (2013.01); *E02D 31/02* (2013.01)

(58) Field of Classification Search
CPC ..... E02D 27/32; E02D 31/02
USPC ..... 52/169.5, 293.1, 294, 299
See application file for complete search history.

(56) References Cited

U.S. PATENT DOCUMENTS 5,017,046 A * 5/1991 Sugimoto ..... E02D 31/12 405/229
5,228,805 A * 7/1993 Chang ..... E02D 31/10 405/229
5,474,399 A * 12/1995 Chia-Hsiung ..... E02D 27/00 405/133
5,924,251 A 7/1999 Jalla
5,924,264 A 7/1999 Vierra
6,477,811 B1 * 11/2002 Choi ..... E04B 1/7023 52/169.11
6,766,620 B2 7/2004 Robbins
7,003,918 B2 * 2/2006 Williams ..... E02D 31/14 52/169.14
7,488,523 B1 * 2/2009 Muncaster ..... B32B 11/04 404/17
8,807,876 B2 8/2014 Affi
2003/0188496 A1 * 10/2003 Williams ..... E02D 27/14 52/169.1
2005/0050819 A1 * 3/2005 Chen ..... E02D 27/01 52/293.1
2008/0025795 A1 * 1/2008 Purnell ..... E02D 31/02 405/36
2011/0120036 A1 5/2011 Wignall et al.
2012/0102851 A1 * 5/2012 Scarfo ..... E04B 1/7023 52/169.5
2015/0361635 A1 12/2015 Davis

* cited by examiner

*Primary Examiner* — Charles A Fox
*Assistant Examiner* — James Buckle, Jr.
(74) *Attorney, Agent, or Firm* — Richard C. Litman

(57) ABSTRACT

The expansive soil resistant foundation system includes a foundation frame having footings forming a grid pattern. The grid pattern contains a plurality of spaces within the pattern. Each space defines a main swell duct. Each main swell duct may be provided with one or more sub-swell ducts. The swell ducts permit free expansion and contraction of the expansive soil. A vent extends from each swell duct to expel trapped air. A drainage system is distributed throughout the foundation frame to eliminate accumulation of underground water. The swell ducts, vents, and the drainage system alleviate potential pressures that can be exerted on the foundation from the expansion and contraction of the expansive soil, which can lead to cracks and structural failure.

4 Claims, 12 Drawing Sheets

EXPANSIVE SOIL RESISTANT FOUNDATION SYSTEM

BACKGROUND OF THE INVENTION

1. Field of the Invention

The present invention relates to construction, and particularly to an expansive soil resistant foundation system that compensates for expansion and contraction of the expansive soil (ES) to provide a secure foundation resistant to potential cracking and failure due to such action.

2. Description of the Related Art

Any type of construction for various structures requires a strong and stable foundation, especially for buildings. The geography of a building site, however, may not always be ideal for a construction project.

For example, expansive soil ES presents a huge technical problem for civil engineers, architects, and other construction professionals. This type of soil is problematic because it can cause many construction problems and failures due to its characteristic behavior of swelling-shrinkage cycles between wet and dry conditions. Expansive soil ES tends to easily expand when exposed to water and to easily shrink when drying. The swelling and shrinkage behavior of the expansive soil ES produces unexpected pressure and stresses on a typical foundation system and structural elements, resulting in cracks and damage to structural components.

Some conventional solutions for handling expansive soil ES include (1) removing the expansive soil ES and replacing it with other non-expansive soil; (2) treating expansive soil ES by mixing it with some chemicals or such materials as lime, polymeric materials, or carton or polystyrene forms under the structure to absorb water; (3) avoiding construction on expansive soils; and (4) constructing short and lightweight buildings on deep foundations, such as pile systems with pile caps, piers or trenches.

The first method produces good results in most cases, but it is relatively costly and does not completely resolve the problem, since the danger still exists and may cause problems in the long run. The second method is difficult to implement or impractical, and the results are unsure. The third method merely avoids the problem and not a good solution, especially if there is insufficient area of non-expansive soils suitable for necessary construction. The fourth method is a costly and very expensive construction being applied to short and lightweight structures. The fourth method is usually more suitable for high rise and heavy structures, which already will not be affected much by expansive soil behavior.

Currently, there appears to be no permanent economical solution for construction on expansive soils that prevents the possibility of cracks and failure due to the swelling/shrinkage phenomenon. Moreover, there does not appear to be a solution that maintains a relatively even, temperate condition of the soil of the foundation, i.e., neither wet nor dry, at all times. Thus, an expansive soil resistant foundation system solving the aforementioned problems is desired.

SUMMARY OF THE INVENTION

The expansive soil resistant foundation system includes a foundation frame having footings forming a grid pattern. The grid pattern contains a plurality of spaces within the pattern. Each space defines a main swell duct. Each main swell duct may be provided with one or more sub-swell ducts. The swell ducts permit free expansion and contraction of the expansive soil. A vent extends from each swell duct to expel trapped air. A drainage system is distributed throughout the foundation frame to eliminate accumulation of underground water. The swell ducts, vents, and the drainage system alleviate potential pressures that can be exerted on the foundation from the expansion and contraction of the expansive soil, which can lead to cracks and structural failure.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The expansive soil resistant foundation system, generally referred to by the reference number 10 in the Figures, provides the required structural support for construction on expansive soil ES with features compensating for expansion/swelling and contraction/shrinkage of the expansive soil ES, thereby alleviating potential crack formation, damage, and related problems. The expansive soil resistant foundation system 10 presents a more permanent solution for construction on expansive soil ES.

Figure 1A:
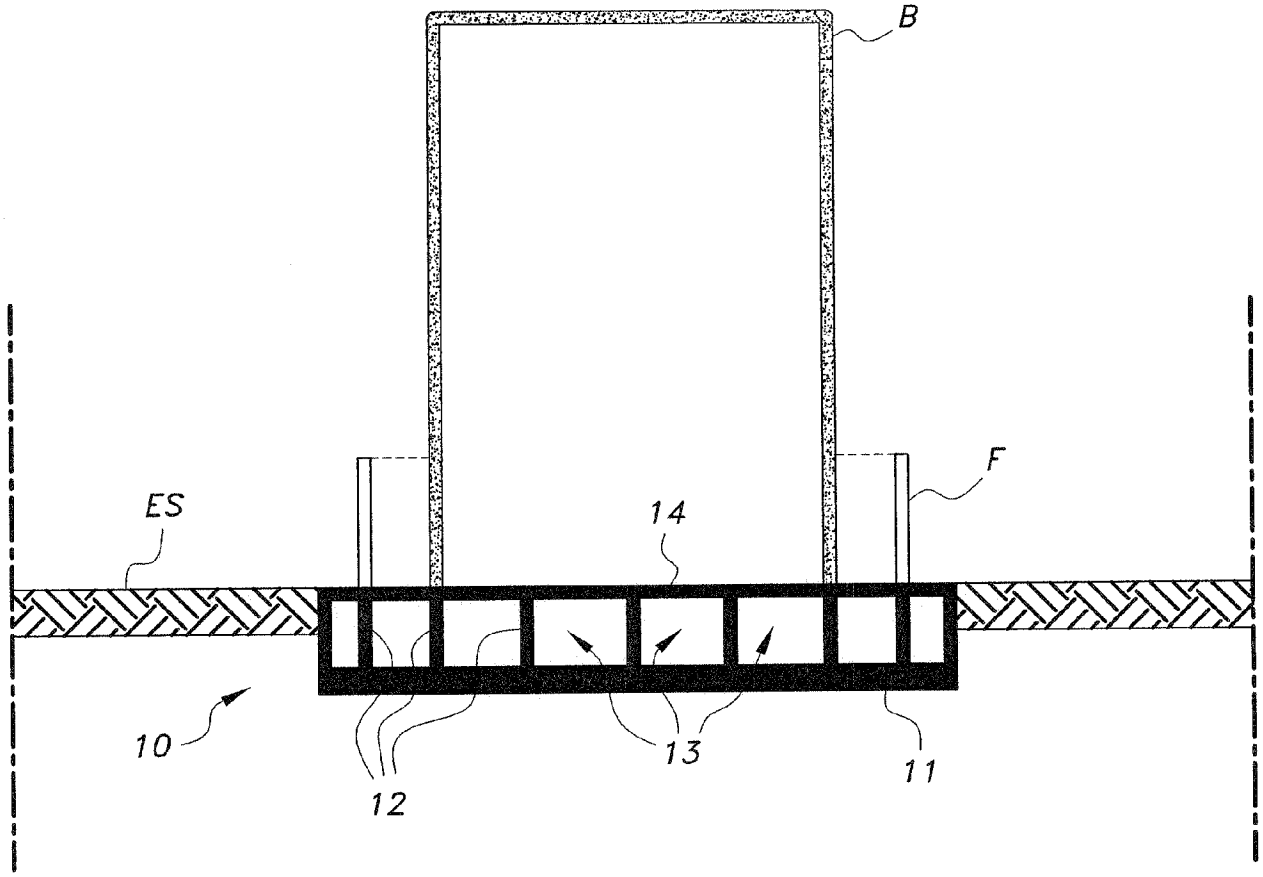
FIG. 1A is a diagrammatic diagram of an expansive soil resistant foundation system according to the present invention, shown for a typical building without a basement.
Figure 1B:
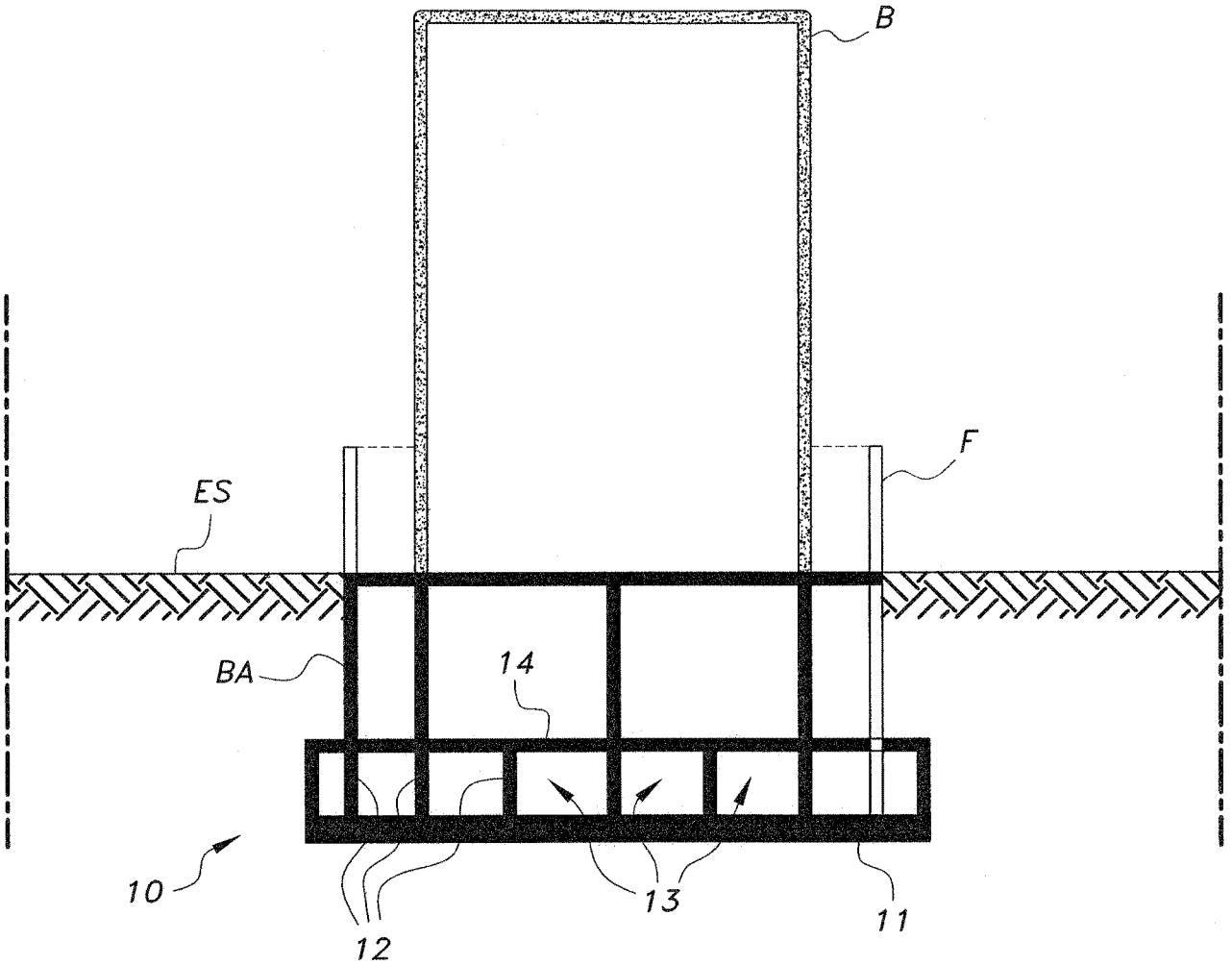
FIG. 1B is a diagrammatic diagram of an expansive soil resistant foundation system according to the present invention, shown for a building with a basement.

The expansive soil resistant foundation system 10 includes a foundation frame having a shallow foundation 11 of rigid continuous rib footing 40, or transversely connected unidirectional or bi-directional rigid continuous beam footings 40, as shown in FIGS. 4-7. As best seen in FIGS. 1A and 1B, the expansive soil resistant foundation system 10 may be the foundation for typical buildings B with or without a fence F and/or a basement BA. Moreover, the expansive soil resistant foundation system 10 may be applied to constructions involving single or multistoried buildings B and/or basements BA.

As best seen in FIGS. 1A, 1B, 2A, 2B, and 2C, a plurality of support walls 12 extend upward from the shallow foundation 11 to form a general grid pattern. The pattern, in turn, forms open spaces or cells, each open space or cell defining a main swell duct 13. The support walls 12 are preferably constructed from reinforced concrete. A ceiling slab 14 covers the shallow foundation 11 and the support walls 12. The ceiling slab 14 is preferably constructed from concrete or reinforced concrete. In the basement-type construction shown in FIG. 1B, the basement BA may be built on top of the ceiling slab 14. Thus, the ceiling slab 14 serves as a floor and supports the superstructure of a particular construction.

Each main swell duct 13 provides space for free expansion and contraction of the expansive soil ES without impacting the foundation and/or structure. This substantially eliminates much of the potential stresses normally experienced by a typical foundation built on expansive soil ES.

Figure 2A:
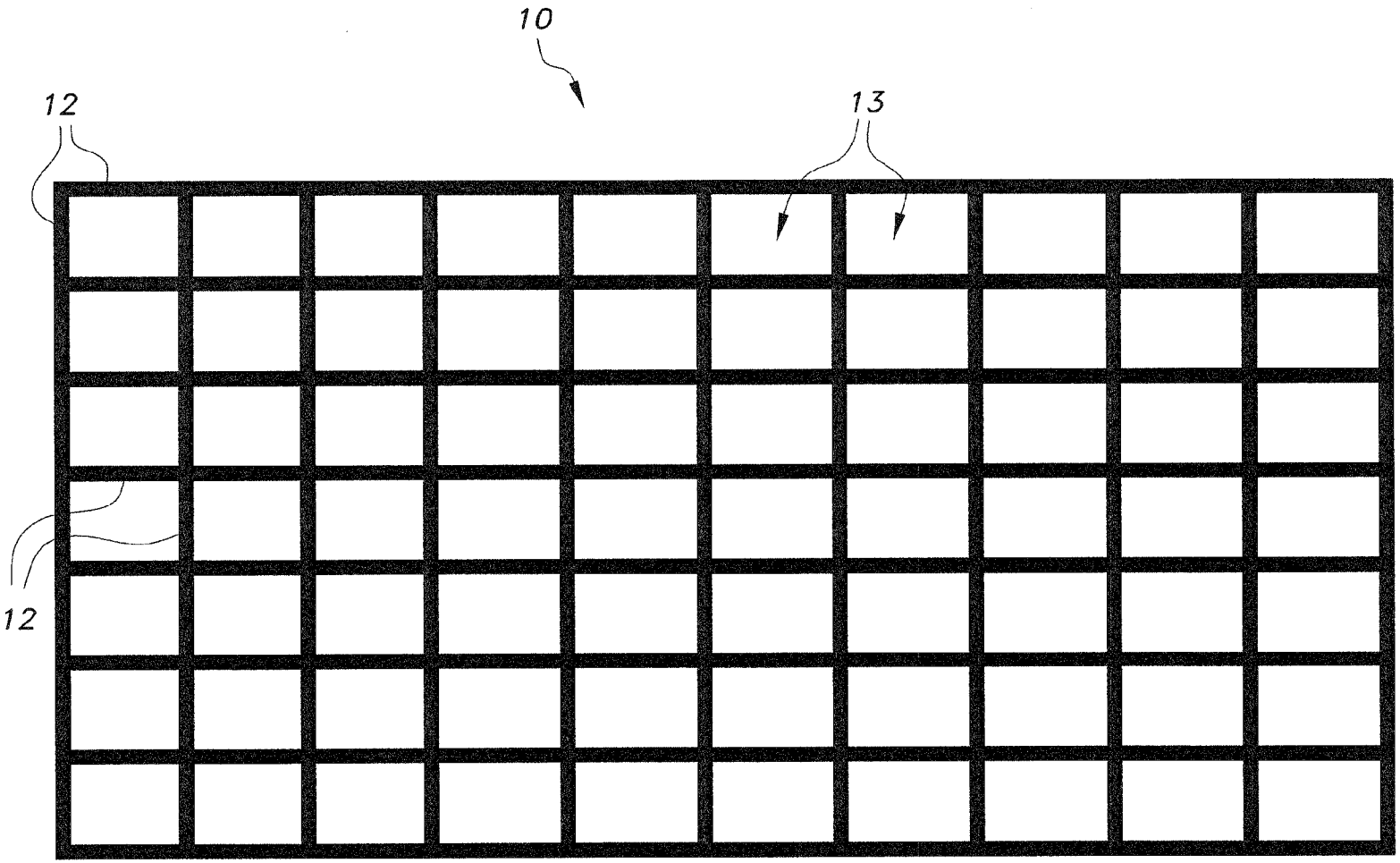
FIG. 2A is a diagrammatic top plan view of a foundation frame for the expansive soil resistant foundation systems of FIGS. 1A and 1B, the frame having a plurality of main swell ducts formed therein.
Figure 2B:
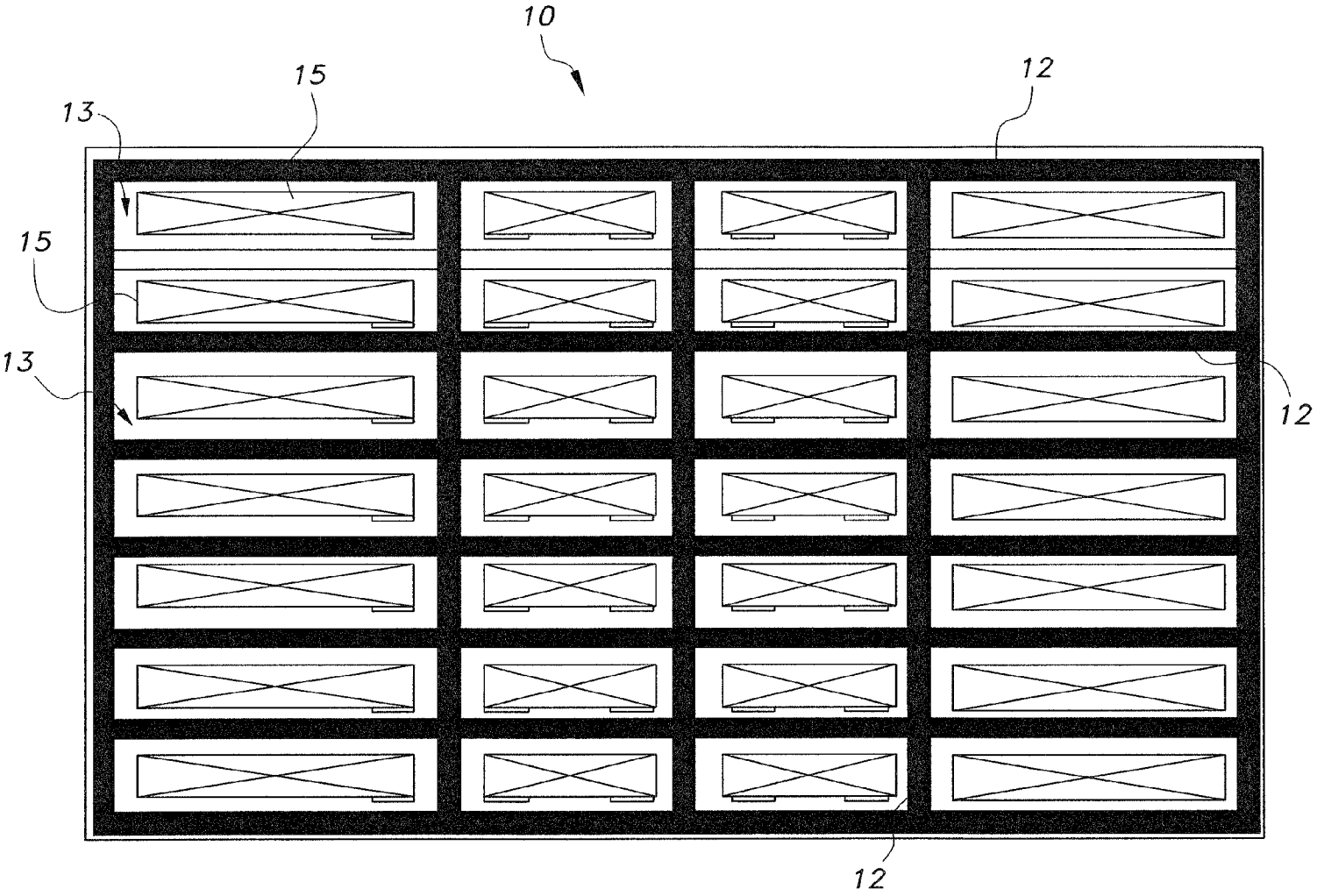
FIG. 2B is a diagrammatic top plan view of a foundation frame similar to the frame of FIG. 2A, but with sub-swell ducts disposed within each main swell duct.
Figure 4:
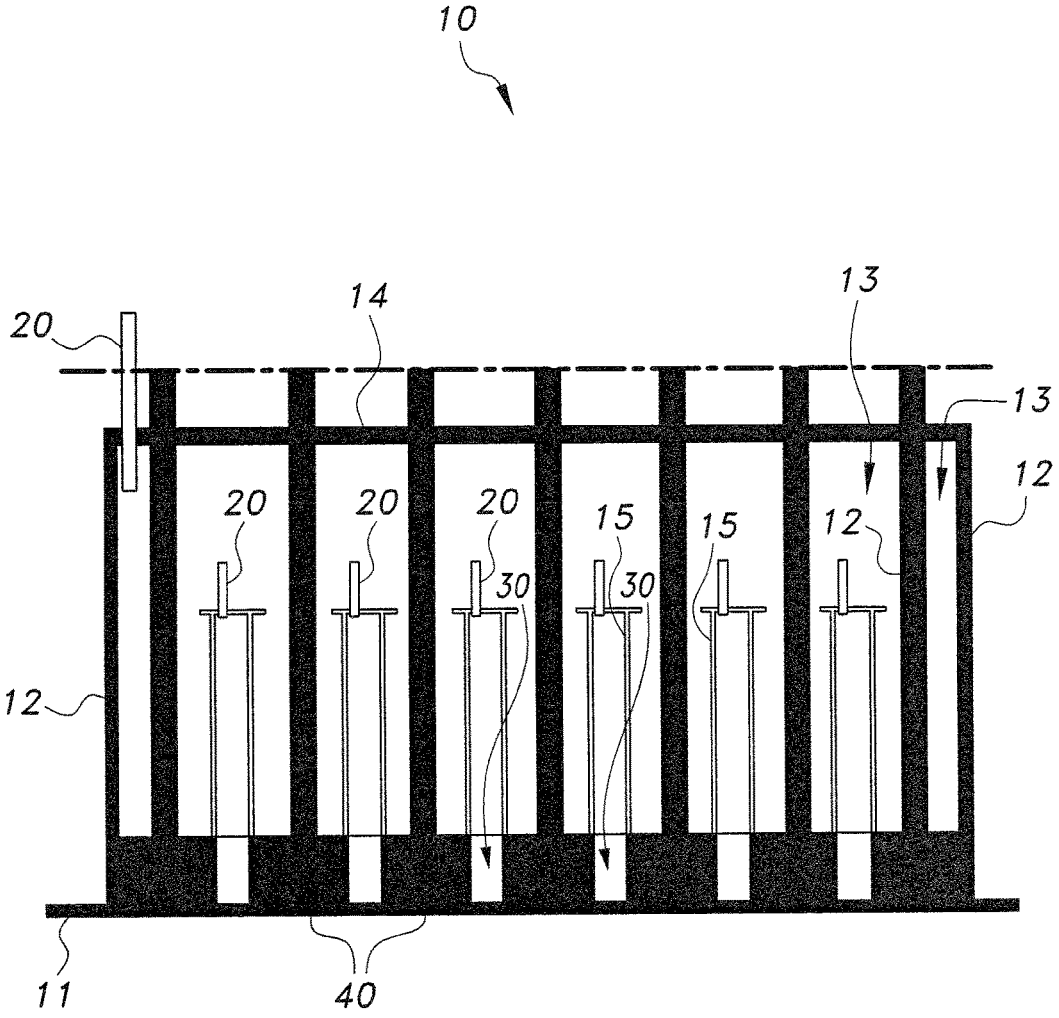
FIG. 4 is a diagrammatic side view in section of the expansive soil resistant foundation systems of FIGS. 1A and 1B, showing an air venting subsystem and a dewatering subsystem.

As best shown in FIGS. 2B and 4, each main swell duct 13 may include one or more sub-swell ducts 15, especially in a raft foundation or footing. Each sub-swell duct 15 may be a hollow, columnar structure disposed within the corresponding main swell duct 13. The sub-swell duct 15 (or group of sub-swell ducts 15) may be left alone within the main swell duct 13, or may be surrounded by fill. In either configuration, each sub-swell duct 15 performs the same function, in that each sub-swell duct 15 permits the expansive soil ES to freely expand and contract.

Figure 2C:
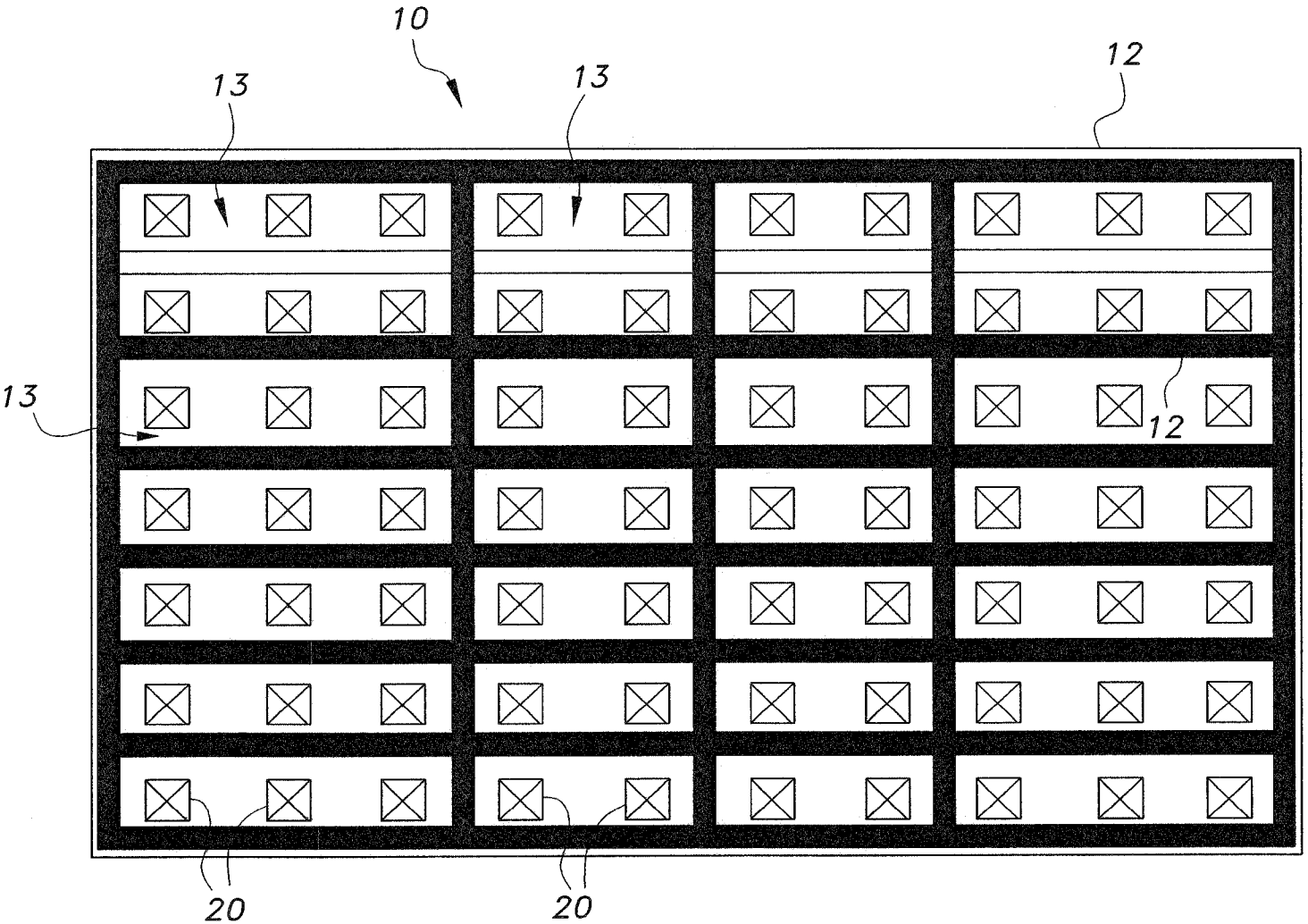
FIG. 2C is diagrammatic top plan view of another embodiment of a foundation frame for the expansive soil resistant foundation systems of FIGS. 1A and 1B.

The expansive soil resistant foundation system 10 also includes one or more vacuum vents 20 and a drainage system 30 for processing underground water. As best seen in FIGS. 2C and 4, each main swell duct 13 and sub-swell duct 15 is provided with one or more of the vacuum vents 20 to permit air to escape. The expansion and contraction, as well as environmental temperature gradients affecting the expansive soil ES, cause the air trapped in the main swell duct 13 and/or sub-swell duct 15 to expand, especially during high heat conditions. Expanding air places pressure against the support walls 12 or the walls of the sub-swell ducts 15, which may lead to crack formation and possible failure over time. To counteract such pressures, the vacuum vents 20 enable the air to escape to relieve this pressure.

Figure 3A:
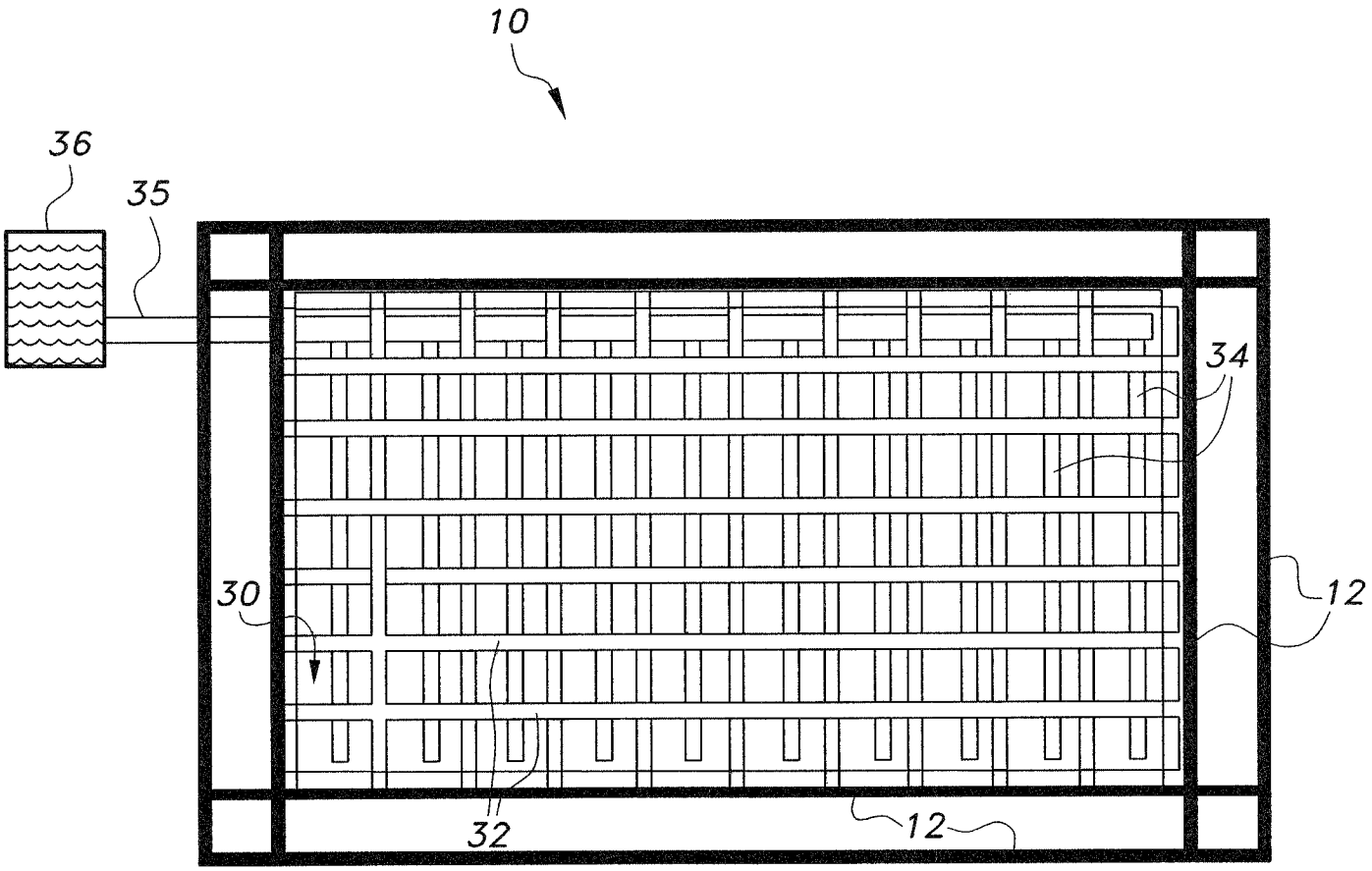
FIG. 3A is a diagrammatic top plan view of a dewatering subsystem for the expansive soil resistant foundation systems of FIGS. 1A and 1B.
Figure 3B:
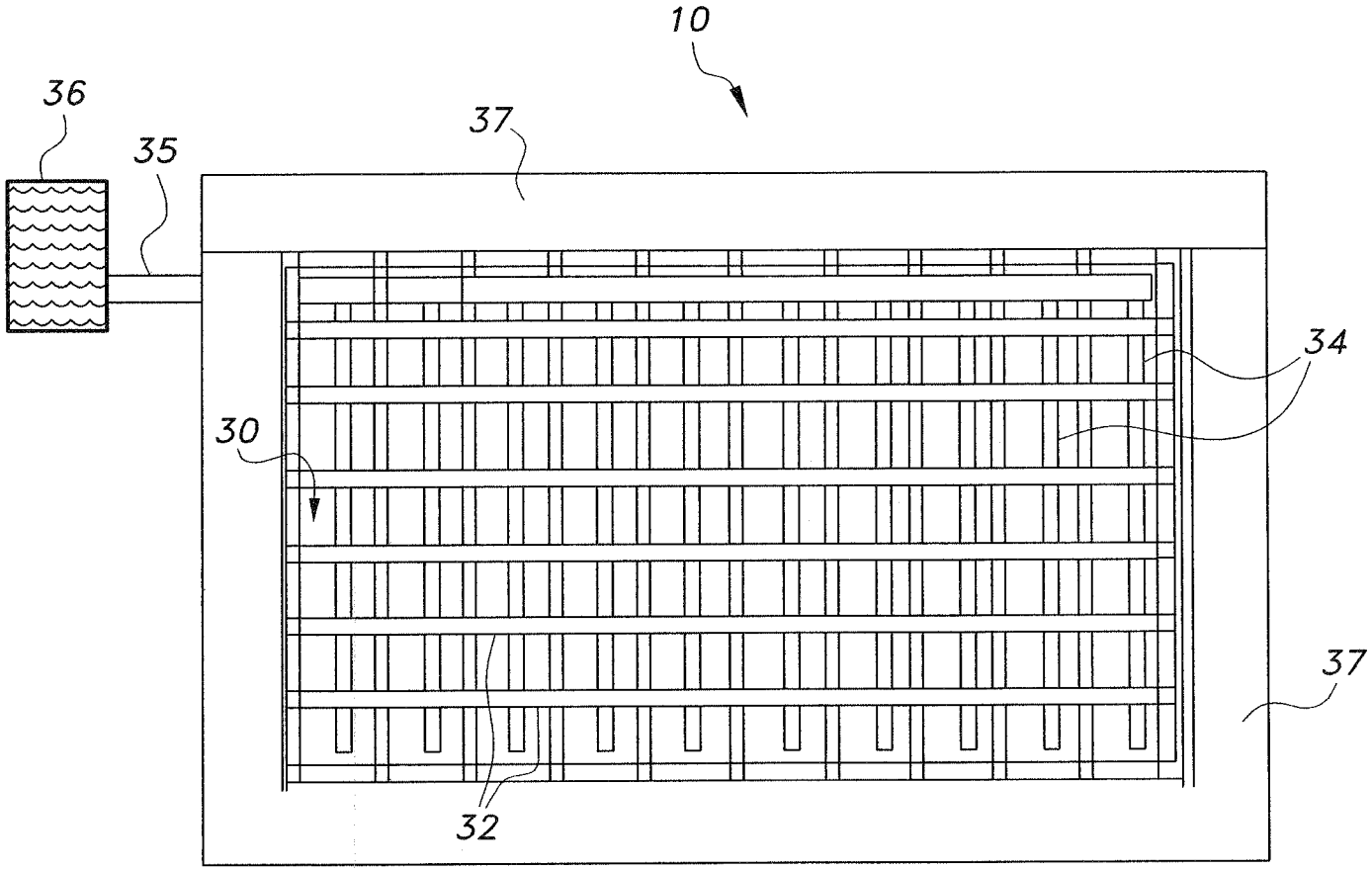
FIG. 3B is a diagrammatic top plan view of the dewatering subsystem of FIG. 3A, shown with capped walls.

An example of the drainage system 30 is shown in FIGS. 3A, 3B, 4, 8A, 8B, 9A, and 9B. The drainage system 30 may include a plurality of dewatering or drainage pipes 32, 34 extending through each main swell duct 13 and sub-swell duct 15. As shown in FIG. 3A, the drainage pipes 32, 34 may comprise a first array of drainage pipes 32 and a second array of drainage pipes 34, where the first array 32 communicates with the main swell ducts 13 and the second array 34 communicates with the sub-swell ducts 15, or vice versa. Both arrays 32, 34 feed into a main drain pipe 35, and all the water flowing through the arrays 32, 34 drains into a drain collection tank 36 remote from the foundation frame. In most instances, the drainage may be accomplished passively. If more active means is necessary, the drainage system 30 may be provided with a pump (not shown) to positively move the water through the drainage system 30. Cap panels 37 cover the walls surrounding the arrays 32, 34. The cap panels 37 are preferably constructed from reinforced concrete.

Figure 8A:
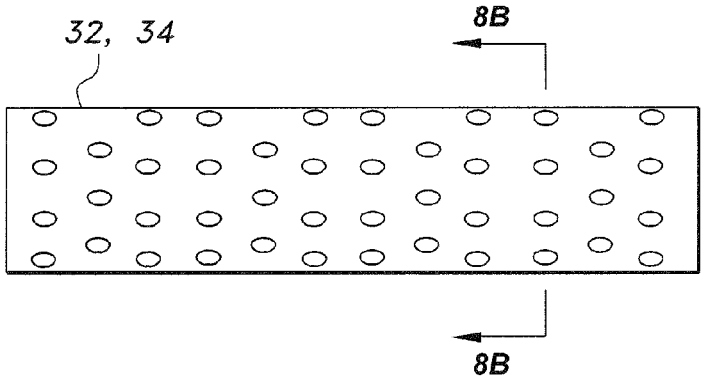
FIG. 8A is a side view of an exemplary drain pipe for the expansive soil resistant foundation systems of FIGS. 1A and 1B.
Figure 8B:
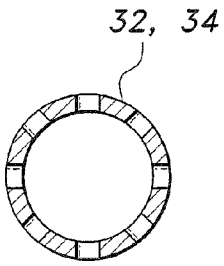
FIG. 8B is a section view along lines 8B-8B of FIG. 8A.
Figure 9A:
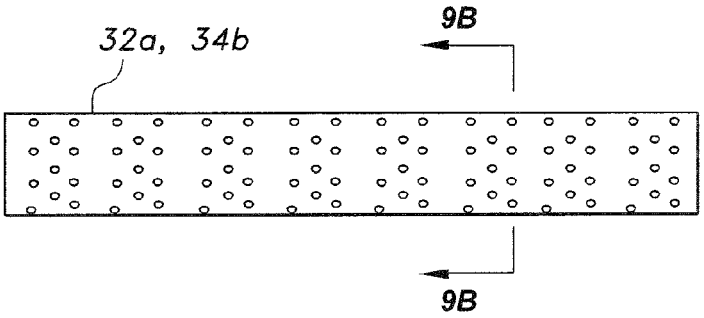
FIG. 9A is a side view of another exemplary drain pipe for the expansive soil resistant foundation systems of FIGS. 1A and 1B.
Figure 9B:
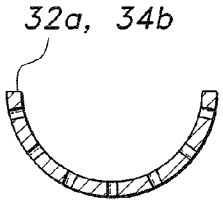
FIG. 9B is section view along lines 9B-91 of FIG. 9A.

As shown in FIGS. 8A and 8B, each drainage pipe 32, 34 is preferably an elongate, perforated pipe surrounded by gravel or other earthen materials during use, where the perforations permit underground water to drain into the pipe. Alternatively, the drainage pipe 32*a*, 34*a* may be an elongate half-pipe having perforations, the half-pipe 32*a*, 34*b* forming a channel for a similar function, as shown in FIGS. 9A and 9B.

Figure 5:
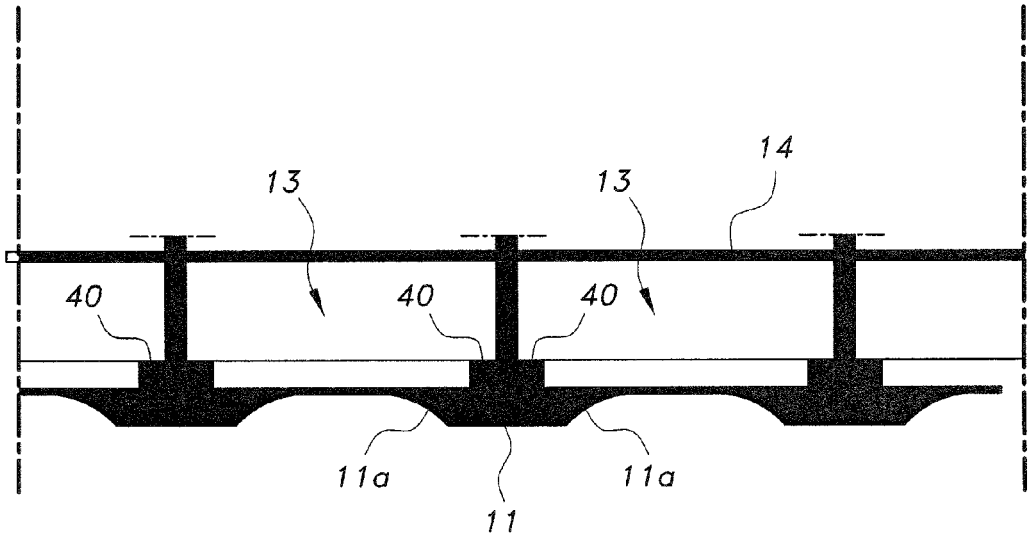
FIG. 5 is a diagrammatic side view in section of a footing assembly for the expansive soil resistant foundation systems of FIGS. 1A and 1B.
Figure 6:
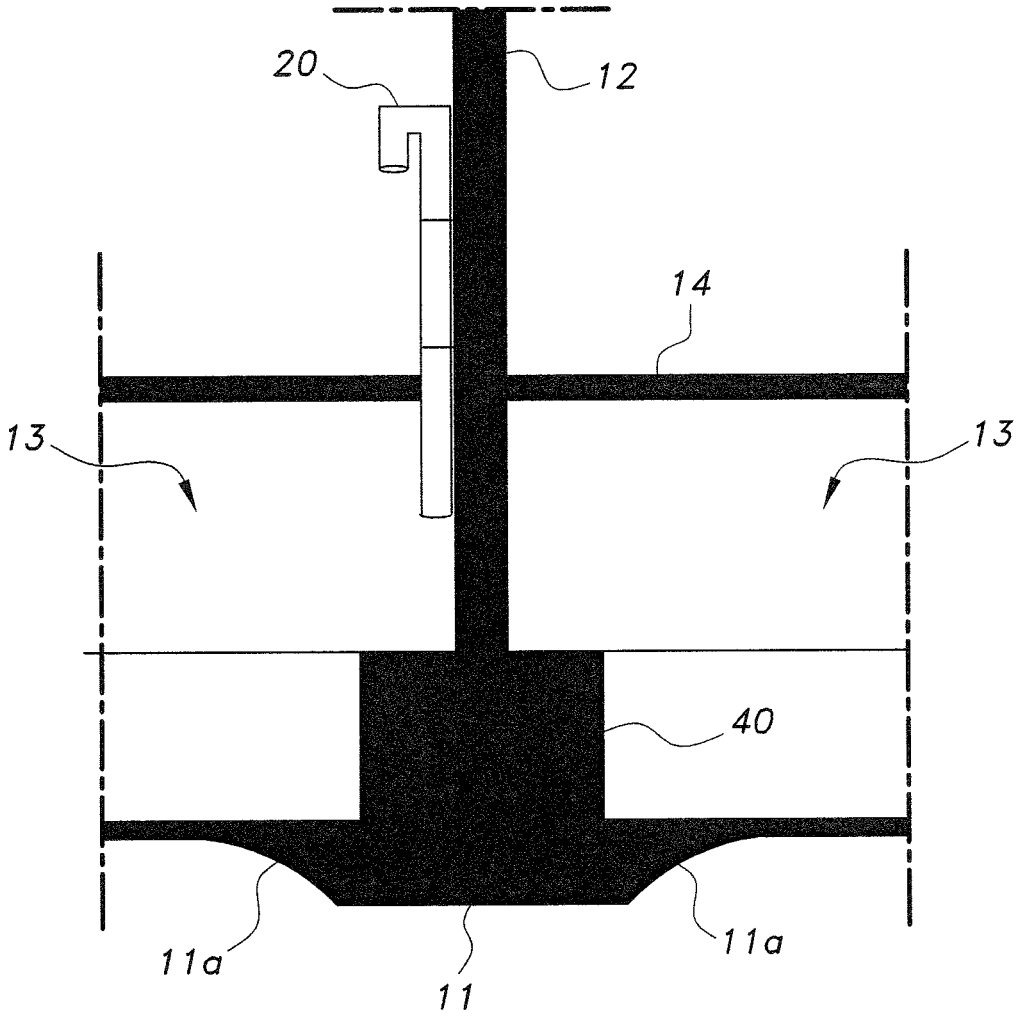
FIG. 6 is a detailed, diagrammatic side view in section of an air venting subsystem for an expansive soil resistant foundation system according to the present invention.
Figure 7:
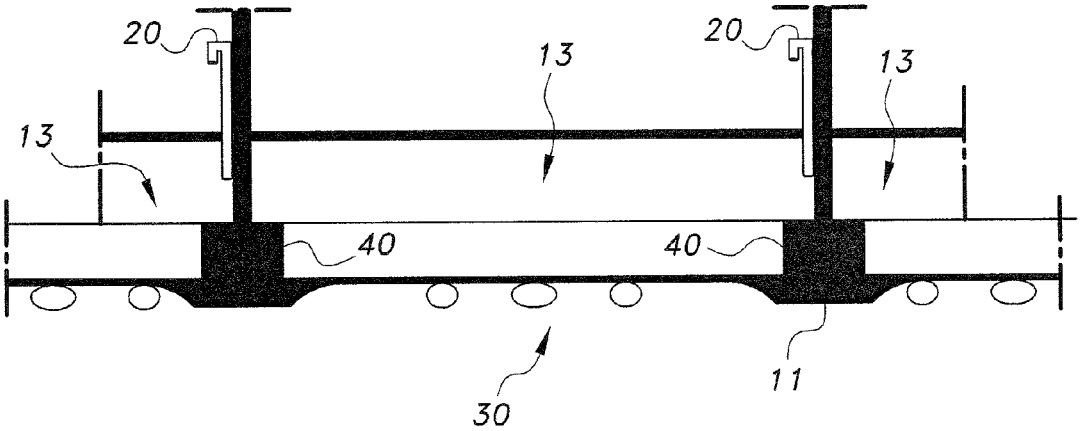
FIG. 7 is a diagrammatic side view in section of the air venting subsystem in combination with underlying drainage for an expansive soil resistant foundation system according to the present invention.

The footings 40 anchor the expansive soil resistant foundation system 10. The footings 40 rest on the shallow foundation 11, and the shallow foundation 11 is preferably constructed to distribute the load of the superstructure more widely and evenly. As best seen in FIGS. 5-7, the shallow foundation 11 may include spaced arches 11*a*, where each arch 11*a* provides greater surface area resting on the soil. The greater surface area enables wider and more even distribution of the load.

Thus, it can be seen that the expansive soil resistant foundation system 10 provides a more permanent solution for construction on expansive soil. The swell ducts 13, 15 provide space for free expansion and contraction of the expansive soil ES over time. While the swell ducts 13, 15 compensate for earthen volumetric changes, the vents 20 compensate for potential gaseous expansion. Both features alleviate potential structural pressures that can lead to cracks and failure of the foundation. Moreover, the drainage system 30 rids the foundation of any groundwater that can accumulate and cause excessive expansion of the expansive soil ES.

It is to be understood that the present invention is not limited to the embodiments described above, but encompasses any and all embodiments within the scope of the following claims.

We claim:

1. An expansive soil resistant foundation system adapted to alleviate potential pressures exerted on the foundation system due to expansion and contraction of expansive soil, comprising:

a foundation frame having a foundation, the foundation including a plurality of footings, a plurality of support walls extending upward from the foundation and footings to form a grid pattern defining spaces therein, and a ceiling slab atop the support walls, the ceiling slab being adapted to support a building superstructure thereon;

a main swell duct defined in each space in the grid pattern;

at least one sub-swell duct disposed inside each of the main swell ducts;

at least one vent extending from each main swell duct and each sub-swell duct, the at least one vent expelling trapped air; and a drainage system distributed throughout the foundation frame to drain groundwater from the foundation system, wherein the drainage system is coextensive with the foundation frame and comprises:

a plurality of drain pipes communicating with each of the main swell ducts and the sub-swell ducts;

a main drain pipe coupled to the plurality of drain pipes, underground water inside the plurality of drain pipes flowing into the main pipe; and a drain collection tank coupled to the main drain pipe, the drain collection tank holding underground water flowing through the main drain pipe.

2. The expansive soil resistant foundation system according to claim 1, wherein said foundation comprises a plurality of spaced arches formed therein.

3. The expansive soil resistant foundation system according to claim 1, wherein each of the plurality of drain pipes is formed from perforated pipe.

4. The expansive soil resistant foundation system according to claim 3, wherein each of the perforated pipes is configured as a half-pipe.

* * * * *